United States Patent [19]

Bairen et al.

[11] 4,433,870

[45] Feb. 28, 1984

[54] COLLAPSIBLE SPORTSMAN'S STOOL

[76] Inventors: Donald J. Bairen, 856 McLaughlin Rd.; Thomas M. Lucas, 725 Chartiers St. (rear), both of Bridgeville, Pa. 15017

[21] Appl. No.: 268,564

[22] Filed: May 29, 1981

[51] Int. Cl.[3] ..... A47C 4/00

[52] U.S. Cl. ..... 297/16; 248/188.5; 248/188.7; 297/4

[58] Field of Search ..... 297/16, 4; 248/155.4, 248/155.5, 155, 188.7, 188.5

[56] References Cited

U.S. PATENT DOCUMENTS

| | | | |
|---|---|---|---|
| 699,932 | 5/1902 | Smith | 297/4 |
| 759,809 | 5/1904 | Farley | 297/4 |
| 3,503,390 | 3/1970 | Peters | 248/188.5 X |
| 3,985,387 | 10/1976 | Rischar | 297/16 X |
| 4,101,163 | 7/1978 | Morin | 297/16 |

FOREIGN PATENT DOCUMENTS

| | | | |
|---|---|---|---|
| 70686 | 12/1958 | France | 248/188.7 |

*Primary Examiner*—James T. McCall
*Attorney, Agent, or Firm*—William J. Ruano

[57] ABSTRACT

A stool which is fully collapsible and adjustable to four different positions. It is particularly suitable for the sportsman, such as the hunter and fisherman. While spot hunting deer it will give the same high view as if standing and, at the same time, support the backside and legs and lower back of the sportsman. The fisherman can use it while "spinning" in a stream without sinking in the creek's soft bottom in view of a platform shaped base. It is also useful around the house to support the housewife while ironing, doing dishes or working around a work bench. It may be carried by a strap around the shoulder or by a belt.

1 Claim, 3 Drawing Figures

COLLAPSIBLE SPORTSMAN'S STOOL

This invention relates to a collapsible stool which is particularly suitable for a sportsman, such as a hunter or fisherman.

An outstanding disadvantage of hunting and fishing is that no suitable means are readily available for resting intermittently and, at the same time, to be on guard for roaming deer or nibbling fish etc. While collapsible chairs are well known in the art, they are entirely unsuitable for fishing, hunting etc.

An object of the present invention is to overcome the disadvantages of well known collapsible chairs by embodying in the construction, a fully collapsible feature that greatly facilitates carrying of the chair or stool and, at the same time, provides a wide range of adjustments and protective features to make it particularly adaptable for the sportsman, although useful for others, such as the house wife, golf match spectators, worker at a work table etc.

Other objects and advantages of the invention will become more apparent from a study of the following description taken with the accompanying drawing wherein.

Figure 1:
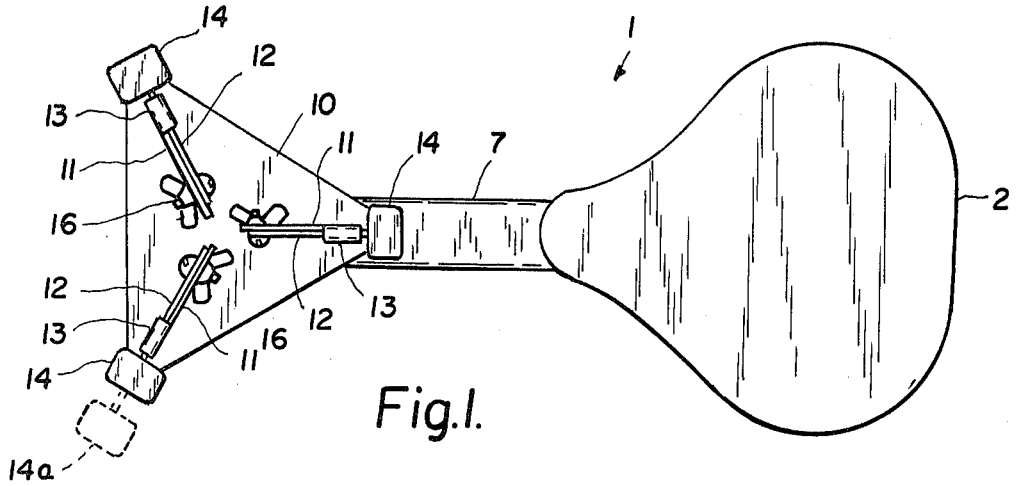
FIG. 1 is a top view of a stool embodying the principles of the present invention.
Figure 2:
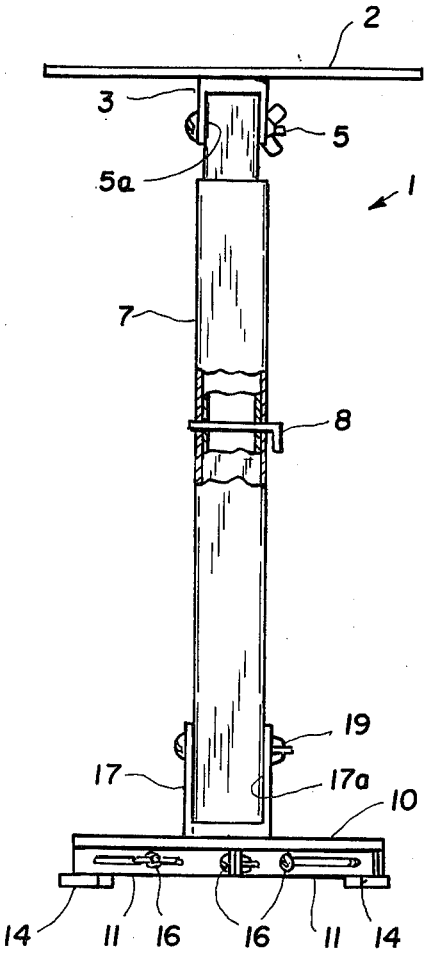
FIG. 2 is a side view thereof with a portion of the supporting post cut away to better illustrate the height adjusting means.

Referring to the drawing, numeral 1 generally denotes a collapsible stool particularly suitable for sportsmen and numeral 2 denotes a seat of aluminum, plastic or other suitable material which may be covered by a cushioned layer (not shown) for greater comfort. Integrally secured to the bottom of seat 2 is an inverted U-shaped bracket 3 having vertical slots 4 on opposite sides thereof to enable pivoting of the seat about a pivot bolt 5 having a bolt head 5*a* at one end and a wing nut at the other. The vertical slots 4 enable the seat 2 to be first lifted and then tilted to the position shown by dotted lines 2*b*. Slots 4 are of sufficient vertical length to allow the seat to be suspended alongside the stool at no greater height than the tube 5*a* which may be of square cross-section and which is telescopically fitted inside vertical post 7 of square or rectangular cross-section so as to enable selective adjustments in the height of the stool or seat 2. More specifically, by providing a plurality of vertically spaced holes, such as 9, and by selectively inserting pin 8 in the selected registering holes, different heights of the stool may be obtained. Instead of pin 8, a pair of conventional pins with a spring in between may be inserted in the tube.

Figure 3:
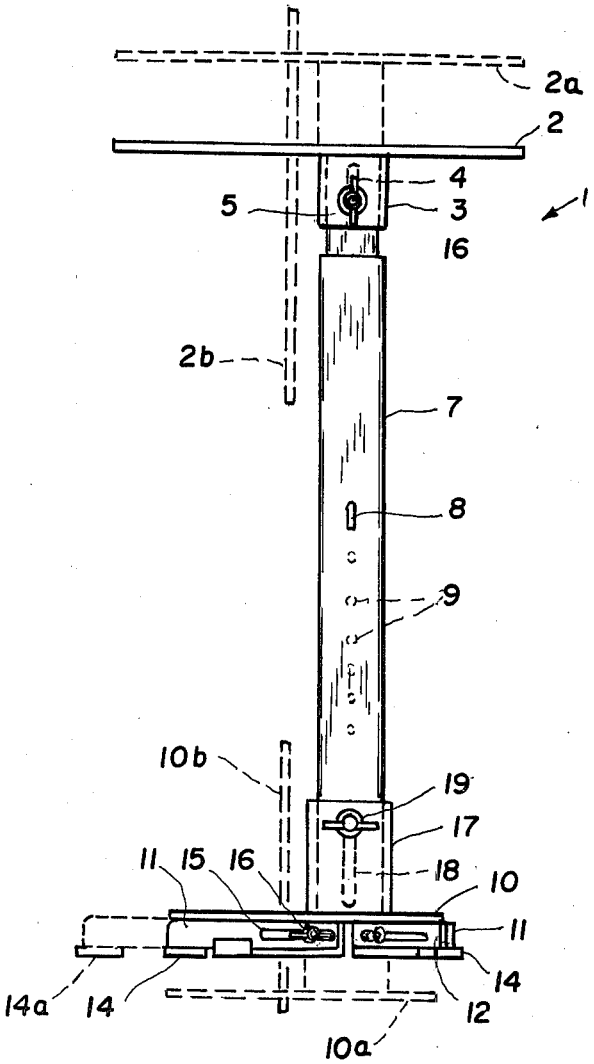
FIG. 3 is a side view as viewed from the right of FIG. 2 and showing, in dotted lines, the collapsible position of the parts thereof.

The bottom of the post 7 is pivotally mounted on a supporting bracket having three upstanding sides forming the legs of a horizontal U-shaped cross-section and being open at one side 17*a*. Vertical slots 18 are provided on opposite sides of the supporting bracket 17 to enable post 7 to be lifted before being tilted to the vertical position of base 10 on which it is inwardly supported,-that is, to the position shown by dash lines 10*b* in FIG. 3. An important feature of the base of the stool is the horizontal platform 10 which may be of triangular construction as shown in FIG. 1 or of other shapes, such as circular, and of sufficient area as to prevent sinking of the post 7 into mud or soft dirt as generally encountered in or near creek beds.

As shown more clearly in FIG. 1, three rigid legs 11 are welded to the bottom of platform 10 with inturned flanges 13 to serve as guides for three outwardly slidable legs 12 to enable three foot pads 14 to be selectively slidable outwardly, such as to the position shown by numeral 14*a* to give a firmer support to the base also legs 11 serve as runners to facilitate sliding or sinking in mud to allow base 10 to lie on the surface. The pads 14 may be rigidly held in any extended position by the tightening of wing nuts 16 on bolts attached to slidable legs 12 which are guided by slots 15, flanges 13 and the underside of base 10.

The various parts thus far described may be made of metal, such as steel or aluminum, or of plastic material or a combination of said materials, particularly lightweight materials.

Thus it will be seen that we have provided a sportsman's stool which is fully collapsible and adjustable in height as well as being reliable in support even under conditions of mud or soft dirt so as to prevent the possibility of sinking of the base of the stool into a mud surface.

We claim:

1. A collapsible stool for sportsmen and the like comprising telescoping tubes having adjusting means for selectively adjusting the amount of extension and height of said tubes, a stool pivotally connected at the top end of one of said tubes and collapsible so as to be positioned alongside said tubes, a base connected at the bottom end of the other of said tubes, pivotal means for pivoting and collapsing said base so as to extend alongside the bottom portion of said tubes, said base including a platform to prevent sinking of said tubes into wet ground, runner-like strips integrally depending vertically from the bottom surface of said platform and having bottom inturned flanges adjustable runner-like strip extensions having lengths comparable to the length of said strips and being slidably mounted on said flanges and alongside said strips to facilitate sliding or sinking in mud to allow said base to lie on the ground surface, and foot pads depending from the extremities of said extensions to adjust the length of said extensions to provide a firm support for said platform.

* * * * *